US006684785B2

(12) United States Patent
Harwood, Jr.

(10) Patent No.: US 6,684,785 B2
(45) Date of Patent: Feb. 3, 2004

(54) LITHOGRAPHIC IMAGING WITH PRINTING MEMBERS HAVING MULTIPHASE LASER-RESPONSIVE LAYERS

(75) Inventor: Gerald P. Harwood, Jr., Billerica, MA (US)

(73) Assignee: Presstek, Inc., Hudson, NH (US)

( * ) Notice: Subject to any disclaimer, the term of this patent is extended or adjusted under 35 U.S.C. 154(b) by 55 days.

(21) Appl. No.: 10/087,401

(22) Filed: Mar. 1, 2002

(65) Prior Publication Data

US 2002/0162469 A1 Nov. 7, 2002

Related U.S. Application Data

(60) Provisional application No. 60/272,609, filed on Mar. 1, 2001.

(51) Int. Cl.[7] ..... B41N 1/08; B41N 1/14

(52) U.S. Cl. ..... 101/457; 101/462; 101/467

(58) Field of Search ..... 101/454, 456, 101/457, 458, 459, 460, 462, 463.1, 465, 466, 467; 430/302

(56) References Cited

U.S. PATENT DOCUMENTS

| | | | | | |
|---|---|---|---|---|---|
| 5,339,737 | A | | 8/1994 | Lewis et al. | 101/454 |
| 5,570,636 | A | | 11/1996 | Lewis | 101/454 |
| 5,605,780 | A | * | 2/1997 | Burberry et al. | 430/278.1 |
| 5,795,647 | A | * | 8/1998 | Robinson et al. | 428/329 |
| 5,985,515 | A | * | 11/1999 | Van Rompuy et al. | 430/272.1 |
| 6,107,001 | A | * | 8/2000 | Lewis et al. | 430/302 |
| 6,182,569 | B1 | | 2/2001 | Rorke et al. | 101/457 |
| 6,182,570 | B1 | | 2/2001 | Rorke et al. | 101/462 |
| 6,186,067 | B1 | | 2/2001 | Rorke et al. | 101/467 |
| 6,192,798 | B1 | | 2/2001 | Rorke et al. | 101/457 |
| 6,207,349 | B1 | | 3/2001 | Lewis | 430/302 |
| 6,251,334 | B1 | | 6/2001 | Lewis | 264/517 |
| 6,374,738 | B1 | | 4/2002 | Lewis et al. | 101/467 |
| 6,378,432 | B1 | * | 4/2002 | Lewis | 101/467 |
| 6,455,222 | B1 | * | 9/2002 | Fukino et al. | 430/270.1 |
| 6,484,637 | B2 | * | 11/2002 | Lewis | 101/456 |
| 6,569,601 | B1 | * | 5/2003 | Bennett et al. | 430/273.1 |

FOREIGN PATENT DOCUMENTS

| | | |
|---|---|---|
| EP | 0 862 998 A1 | 9/1998 |
| EP | 1 088 653 A2 | 4/2001 |
| WO | WO 02/01291 | 1/2002 |

* cited by examiner

*Primary Examiner*—Stephen R. Funk
(74) *Attorney, Agent, or Firm*—Testa, Hurwitz & Thibeault, LLP

(57) ABSTRACT

The present invention provides a printing member having a single radiation-absorptive multiphase layer over a substrate layer that may be imaged with or without ablation.

38 Claims, 8 Drawing Sheets

LITHOGRAPHIC IMAGING WITH PRINTING MEMBERS HAVING MULTIPHASE LASER-RESPONSIVE LAYERS

RELATED APPLICATION

This application claims priority to and the benefits of U.S. Provisional Patent application serial No. 60/272,609, titled "Lithographic Imaging with Printing Members Having Multiphase Laser-Responsive Layers," filed on Mar. 1, 2001.

FIELD OF THE INVENTION

The present invention relates to printing apparatus and methods, and more particularly to imaging of lithographic printing-plate constructions on- or off-press using controlled laser output.

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers.

For example, U.S. Pat. No. 5,493,971 discloses wet-plate constructions that extend the benefits of ablative laser imaging technology to traditional metal-based plates. Such plates remain the standard for most of the long-run printing industry due to their durability and ease of manufacture. As shown in FIG. 1, a lithographic printing construction 100 in accordance with the '971 patent includes a grained-metal substrate 102, a protective layer 104 that can also serve as an adhesion-promoting primer, and an ablatable oleophilic surface layer 106. In operation, imagewise pulses from an imaging laser (typically emitting in the near-infrared, or "IR" spectral region) interact with the surface layer 106, causing ablation thereof and, probably, inflicting some damage to the underlying protective layer 104 as well. The imaged plate 100 may then be subjected to a solvent that eliminates the exposed protective layer 104, but which does no damage either to the surface layer 106 or to the unexposed protective layer 104 thereunder. By using the laser to directly reveal only the protective layer and not the hydrophilic metal layer, the surface structure of the latter is preserved; the action of the solvent does not damage this structure.

This construction relies on removal of the energy-absorbing layer to create an image feature. Exposure to laser radiation may, for example, cause ablation—i.e., catastrophic overheating—of the ablated layer in order to facilitate its removal. Accordingly, the laser pulse must transfer substantial energy to the absorbing layer. This means that low-power lasers must be capable of very rapid response times, and imaging speeds (i.e., the laser pulse rate) must not be so fast as to preclude the requisite energy delivery by each imaging pulse.

In order to reduce or even obviate the need for substantial ablation as an imaging mechanism, U.S. application Ser. No. 09/564,898, now U.S. Pat. No. 6,378,432, the entire disclosure of which is hereby incorporated by reference, discloses a construction combining the benefits of simple construction, the ability to utilize traditional metal base supports, and amenability to imaging with low-power lasers that need not impart ablation-inducing energy levels. As shown in FIGS. 2A–2C and 3A–3B, in one embodiment, a printing member includes a hydrophilic metal substrate 302, a topmost layer 306 that does not significantly absorb imaging radiation, and an intermediate layer 304 that does absorb imaging radiation. The radiation-absorbing layer 304 comprises a radiation-absorptive material (which may be graded through the thickness of layer 304 if desired). In one version as shown in FIGS. 2A–2C, in response to an imaging pulse the absorbing layer 304 debonds from the surface of the adjacent metal substrate; in another version as shown in FIGS. 3A–3B, an interior split is formed within the absorbing layer, facilitating removal of the portion of that layer above the split. In neither case does the absorbing layer undergo substantial ablation. Remnants of the absorbing layer and the overlying layer (or layers) are readily removed by post-imaging cleaning to produce a finished printing plate.

BRIEF SUMMARY OF THE INVENTION

The cost of manufacturing a printing plate is generally a function of the number of plate layers. Because each layer is individually applied in a separate process step, elimination of a layer can materially reduce overall production costs. In accordance with the present invention, the functions performed by layers 304 and 306 are combined into a single layer.

In particular, the present invention provides a printing member having a single radiation-absorptive multiphase layer over a substrate layer that may be imaged with or without ablation. The multiphase layer may be in contact with the substrate layer along an interface. The multiphase layer comprises a polymer-rich phase and an inorganic-rich phase dispersed within the polymer-rich phase. To provide a lithographic image, the printing member is subjected to imaging radiation in an imagewise pattern. The radiation removes or facilitates removal of at least a portion of the multiphase layer but does not affect the substrate. Following imaging, a cleaning step may be used to remove remnants of the portion of the multiphase layer, thereby creating an imagewise lithographic pattern on the printing member. The printing member may now be used for printing.

In preferred embodiments, a printing member in accordance with the invention comprises a multiphase layer and a substrate. In one embodiment, the substrate is a metal substrate. Suitable metal substrates include, but are not limited to, aluminum, copper, steel, and chromium. In a preferred embodiment, the metal substrate is grained, anodized, and/or silicated. For example, the substrate may be aluminum. In another embodiment, the substrate is a polymer substrate. Suitable polymer substrates include, but are not limited to, polyesters, polycarbonates, and polystyrene. In a preferred embodiment, the substrate is a polyester film, and preferably a polyethylene terephthalate film. In still another embodiment, the substrate is a paper substrate.

The multiphase layer may comprise a polymer-rich phase and an inorganic-rich phase. Suitable materials for the polymer-rich phase include, but are not limited to, polyvinyl alcohols, copolymers of polyvinyl alcohol, polyvinyl pyrrolidone and its copolymers, and polyvinylether and copolymers thereof. In a preferred embodiment, the polymer is a polyvinyl alcohol. The inorganic-rich phase contains one or more inorganic oxides, typically formed as a reaction product of an initially soluble complex. Such inorganic oxides may include, for example, zirconium oxide (typically $ZrO_2$), aluminum oxide (typically $Al_2O_3$), silicon dioxide and titanium oxide (typically $TiO_2$), as well as combinations and complexes thereof. It should also be noted that these oxides may exist in hydrated form. In a preferred embodiment, the inorganic-rich phase comprises "nodules" rich in zirconium oxide. Preferably, the nodules are dispersed within the polymer-rich phase. In one embodiment, the inorganic-rich phase further comprises an inorganic-rich interfacial layer at the interface of the multiphase layer with the metal substrate. In a preferred embodiment, the interfacial layer comprises zirconium oxide, and may have a thickness of 5 nm or less.

In preferred embodiments, the multiphase layer comprises a material that absorbs imaging radiation. In one embodiment, the absorptive material renders the multiphase layer subject to ablative absorption of imaging radiation. Thus, the imaging mechanism is ablative in nature, whereby at least a portion of the multiphase layer is destroyed by the laser pulse. For example, laser radiation may remove or facilitate removal of a portion of the multiphase layer above the inorganic-rich interfacial layer. Alternatively, laser radiation may remove or facilitate removal of the entire multiphase layer. In another embodiment, the imaging mechanism is non-ablative in nature. For example, the laser pulse may merely debond a portion of the multiphase layer from the inorganic-rich interfacial layer. Alternatively, the laser radiation may debond the entire multiphase layer from the substrate without substantially ablating the layer. In these cases, the debonded material may then be removed by post-imaging cleaning (see, e.g., U.S. Pat. Nos. 5,540,150; 5,870,954; 5,755,158; and 5,148,746).

The polymer-rich phase of the multiphase layer has a different affinity at least from the substrate for a printing liquid such as an ink or an ink-rejecting fluid. In one embodiment, the substrate is a hydrophilic metal substrate, while the polymer-rich phase is oleophilic. In this configuration, the inherently ink-receptive areas receive laser output and are ultimately removed, revealing the hydrophilic surface that will reject ink during printing. In other words, the "image area" is selectively removed to reveal the "background." Such printing members are also referred to as "positive-working" or "indirect-write." In one version of this embodiment, a portion of the multiphase layer is removed, leaving the exposed surface of the inorganic-rich interfacial layer to serve as the hydrophilic surface. Alternatively, the interfacial layer may be removed either during cleaning or use of the member in printing, exposing the underlying hydrophilic metal substrate.

In another embodiment, the substrate is oleophilic, while the polymer-rich phase is hydrophilic. This configuration results in a "negative-working" or "direct-write" printing member. In this case, the entire multiphase layer is removed, exposing the oleophilic polymer substrate. The unexposed hydrophilic surface remains receptive to ink-rejecting fluids.

It should be understood that, as used herein, the term "plate" or "member" refers to any type of printing member or surface capable of recording an image defined by regions exhibiting differential affinities for ink and/or an ink abhesive fluid. Suitable configurations include the traditional planar or curved lithographic plates that are mounted on the plate cylinder of a printing press, but can also include seamless cylinders (e.g., the roll surface of a plate cylinder), an endless belt, or other arrangement.

Furthermore, the term "hydrophilic" is used in the printing sense to connote a surface affinity for a fluid which prevents ink from adhering thereto. Such fluids include water for conventional ink systems, aqueous and non-aqueous dampening liquids, and the non-ink phase of single-fluid ink systems. Thus, a hydrophilic surface in accordance herewith exhibits preferential affinity for any of these materials relative to oil-based materials.

BRIEF DESCRIPTION OF THE DRAWINGS

The above-discussed and other features and advantages of the present invention will be further appreciated and understood by those skilled in the art from the following detailed description and drawings. The drawings are not necessarily drawn to scale, and like reference numerals refer to the same parts throughout the different views.

DETAILED DESCRIPTION OF THE PREFERRED EMBODIMENTS

Figure 1:
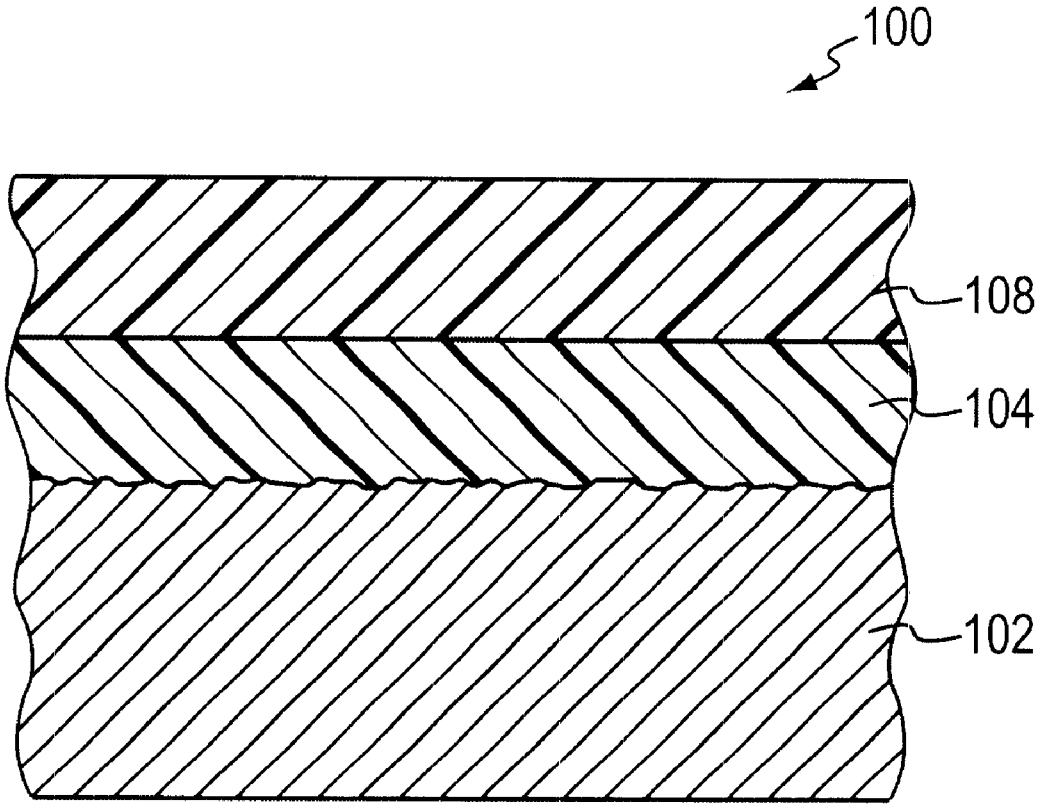
FIG. 1 (PRIOR ART)
FIGS. 1, 2 and 3 are enlarged sectional views of prior-art printing members.
Figure 2A:
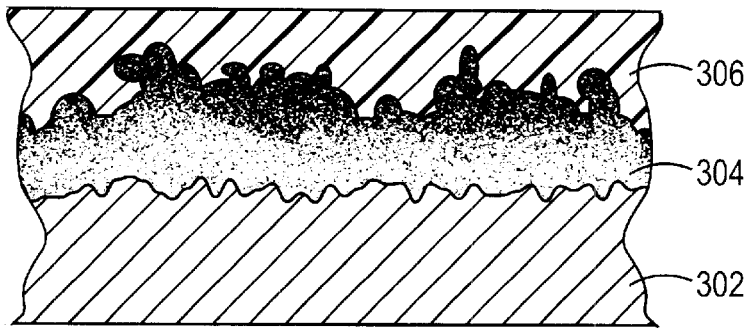
Figure 2B:
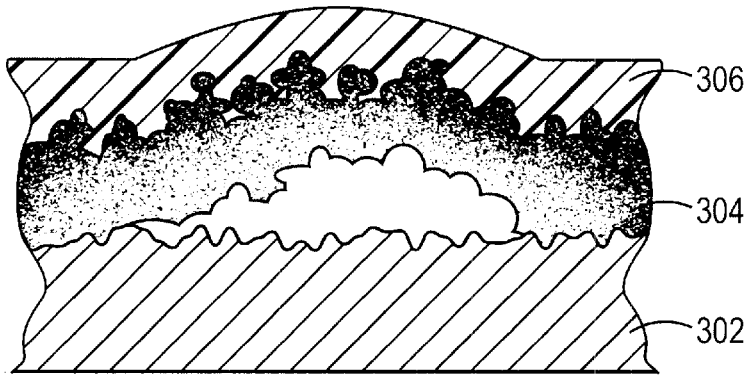
Figure 2C:
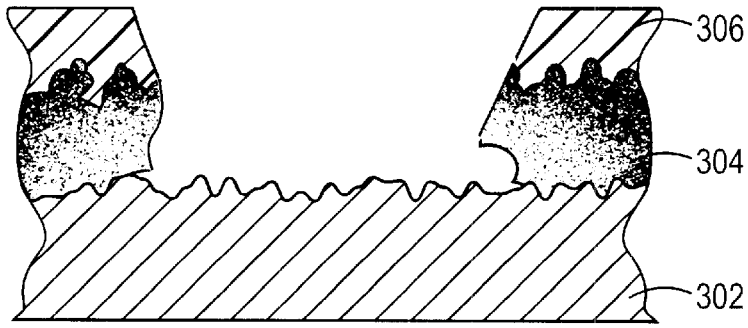
FIG. 2C (PRIOR ART)
Figure 3A:
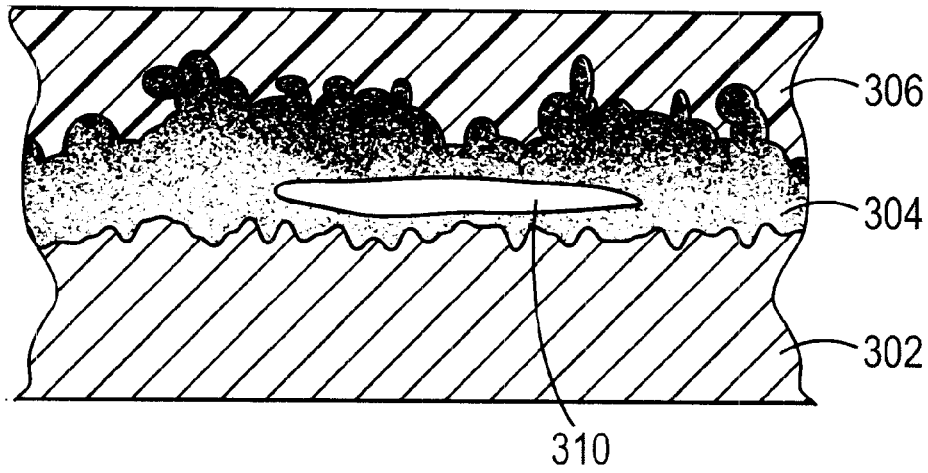
Figure 3B:
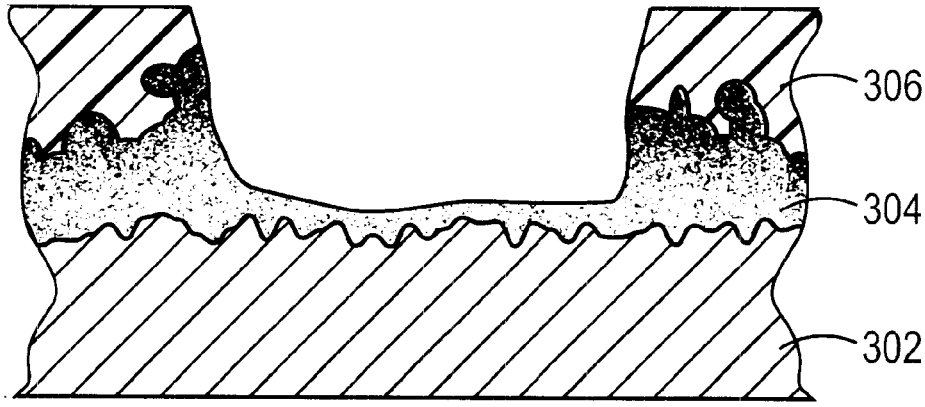
FIG. 3B (PRIOR ART)
Figure 4A:
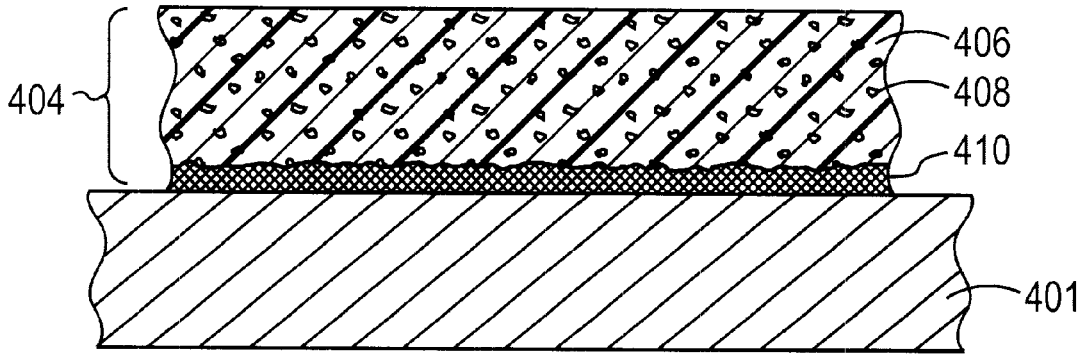
FIG. 4A is an enlarged sectional view of a lithographic printing member having a metal substrate.
Figure 4B:
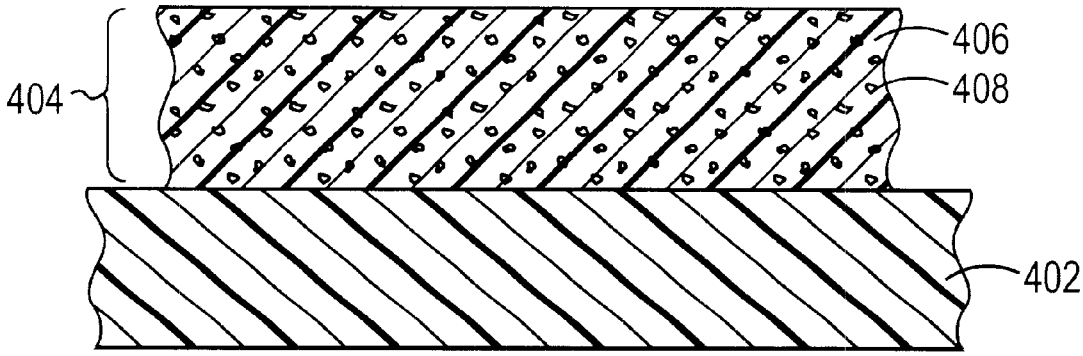
FIG. 4B is an enlarged sectional view of a lithographic printing member having a polymer substrate.

With reference to FIG. 4A, a representative embodiment of a lithographic printing member in accordance herewith includes a metal substrate layer 401, and a radiation-absorptive multiphase layer 404. FIG. 4B illustrates an alternative embodiment that includes a polymer substrate 402 and a radiation-absorptive multiphase layer 404. The multiphase layer 404 comprises a polymer-rich phase 406 and an inorganic-rich phase including 408 and 410. In one embodiment as illustrated in FIG. 4A, the multiphase layer 404 comprises an inorganic-rich interfacial layer 410 at the interface with the metal substrate.

1. Substrate 401, 402

The primary functions of substrate 401, 402 are to serve as a dimensionally stable mechanical support, and to provide different affinity characteristics for ink and/or a fluid to which ink will not adhere. Suitable metals for substrate 401 include, but are not limited to, aluminum, copper, steel, and chromium. Preferred thicknesses range from 0.004 to 0.02 inch, with thicknesses in the range 0.005 to 0.012 inch being particularly preferred.

A metal substrate 401 preferably has a hydrophilic surface to facilitate coating of the multiphase layer 404 and lithographic printing process. A hydrophilic metal surface may promote adhesion to an overlying multiphase layer. In preferred embodiments, a hydrophilic metal surface may promote formation of (and adhesion to) an inorganic-rich interfacial layer 410 within the multiphase layer 404 as described below. Moreover, such a surface may accept an ink-rejecting fluid if overlying interfacial layer 410 is removed during imaging and/or post-imaging cleaning process; or damaged (e.g., by scratching) or wears away during the printing process.

In general, metal layers need to undergo special treatment in order to be capable of accepting ink-rejecting fluids in a printing environment. Any number of chemical or electrical techniques, in some cases assisted by the use of fine abrasives to roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water. Electrograining treatment processes are described in U.S. Pat. No. 4,087,341.

A structured or grained surface can also be produced by controlled oxidation, a process commonly called "anodizing." For example, an anodized aluminum substrate comprises an unmodified base layer and a porous, "anodic" aluminum oxide coating thereover; this coating readily accepts water. However, without further treatment, the oxide coating can lose wettability due to further chemical reaction. Anodized plates are, therefore, typically exposed to a silicate solution or other suitable (e.g., phosphate) reagent that stabilizes the hydrophilic character of the plate surface. In the case of silicate treatment, for example, the surface may assume the properties of a molecular sieve with a high affinity for molecules of a definite size and shape—including, most importantly, water molecules. Anodizing and silicate treatment processes are described in U.S. Pat. Nos. 3,181,461 and 3,902,976.

In another embodiment, the substrate is a polymer substrate 402, preferably having an oleophilic (and possibly also hydrophilic) surface. The oleophilic polymer substrate surface is exposed after imaging radiation and post-imaging cleaning to provide an ink-receptive surface to support lithographic printing. Preferred thicknesses for such substrates range from 0.003 to 0.02 inch, with thicknesses in the range of 0.005 to 0.015 inch being particularly preferred.

A wide variety of polymers (or papers) may be utilized for substrate 402. Typically, papers have been treated (or saturated with a polymeric material) to improve dimensional stability, water resistance, and strength during the wet lithographic printing. Examples of suitable polymeric materials include, but are not limited to, polyesters such as polyethylene terephthalate and polyethylene naphthenate, polycarbonates, and polysulfones. A preferred polymeric substrate comprises polyethylene terphthalate film, such as, for example, the polyester films available under the trademarks of MYLAR and MELINEX polyester films from DuPont Teijin Films, Wilmington, Del.

2. Multiphase Layer 404

The multiphase layer 404 serves two primary functions, namely, absorption of IR radiation and interaction with ink or an ink-rejecting fluid. Examples of an ink-rejecting fluid include water for conventional ink systems, aqueous and non-aqueous dampening liquids, and the non-ink phase of single-fluid ink systems. As shown in FIGS. 4A and 4B, a multiphase layer 404 comprises a polymer-rich phase 406 and an inorganic-rich phase including 408 and 410. In one embodiment, the inorganic-rich phase comprises inorganic-rich nodules 408 that are dispersed in the polymer-rich phase 406. In another embodiment, for example, when the substrate has a hydrophilic metal surface, the inorganic-rich phase may further comprise an interfacial layer 410 at the interface with the metal substrate. This layer 410 may serve as insulating function, preventing imaging energy from dissipating into the underlying metal substrate.

In one embodiment, the polymer-rich phase 406 is the cured product of a polymer and a crosslinking agent. Suitable polymers include, but are not limited to, polyvinyl alcohol or copolymers thereof. In a preferred embodiment, the polymer is polyvinyl alcohol, such as, for example, polyvinyl alcohol available under the trademarks of AIRVOL 325 from Air Products, Allentown, Pa.; and of ESPRIX R-1130 from Esprix Chemical Co. Other suitable polymers include copolymers of polyvinyl alcohol, polyvinyl pyrrolidone (PVP) and copolymers thereof, and polyvinylether (PVE) and its copolymers, including polyvinylether/maleic anhydride versions.

Suitable crosslinking agents include, but are not limited to, zirconium compounds, zinc carbonate, and the like. In a preferred embodiment, the crosslinking agent is ammonium zirconyl carbonate, such as, for example, BACOTE 20, which is an ammonium zirconyl carbonate solution available from Magnesium Elektron, Flemington, N.J., with a weight equivalent of 14% zirconium oxide ($ZrO_2$).

The inorganic crosslinking agents may also serve as the inorganic-rich phase. In a preferred embodiment, the inorganic-rich phase comprises nodules rich in $ZrO_2$, which may be dispersed in the polymer-rich phase. In another embodiment, for example, when the substrate has a hydrophilic metal surface, the inorganic-rich phase may further comprise an inorganic-rich interfacial layer 410 at the interface with the metal substrate. The interfacial layer 410 may comprise $ZrO_2$. In a preferred embodiment, this $ZrO_2$-rich interfacial layer has a thickness of 5 nm or less. Without being bound to any particular theory or mechanism, this $ZrO_2$ rich interfacial layer may result from reaction of the zirconium complex promoted by the anodic layer on the aluminum, the silicate treatment of this layer, or a combination of both.

It is contemplated that the amount of zirconium compound, such as BACOTE 20, utilized in the formulation may be important for formation of the multiphase layer. The optimal amount of BACOTE 20 appears to depend on variables including substrates and co-components of the layer. Effective concentrations can range from 10% to 50%, but are typically 15% to 30%.

Other components and suitable additives may be included in the formulations for the multiphase layer 404 to facilitate coating, curing, or imaging processes. Such components include, but are not limited to, NACURE 2530, a trademark for an amine-blocked organic sulfonic acid catalyst available from King Industries, Norwalk, Conn.; CYMEL 303, a trademark for melamine crosslinking agents available from Cytec Corporation, Wayne, N.J. Suitable additives include, but are not limited to, glycerol, available from Aldrich Chemical, Milwaukee, Wis.; and TRITON X-100, a trademark for a surfactant available from Rohm & Haas, Philadelphia, Pa.; pentaerythritol; glycols such as ethylene glycol, diethylene glycol, trimethylene diglycol, and propylene glycol; citric acid, glycerophosphoric acid; sorbitol; and gluconic acid.

In preferred embodiments, the multiphase layer 404 further comprises an imaging radiation-absorbing material. In the case of IR or near-IR imaging radiation, suitable absorbers include a wide range of dyes and pigments, such as carbon black; nigrosine-based dyes; phthalocyanines (e.g., aluminum phthalocyanine chloride, titanium oxide phthalocyanine, vanadium (IV) oxide phthalocyanine, and the soluble phthalocyanines supplied by Aldrich Chemical Co., Milwaukee, Wis.); naphthalocyanines (see, e.g., U.S. Pat. Nos. 4,977,068; 4,997,744; 5,023,167; 5,047,312; 5,087,390; 5,064,951; 5,053,323; 4,723,525; 4,622,179; 4,492,750; and 4,622,179); iron chelates (see, e.g., U.S. Pat. Nos. 4,912,083; 4,892,584; and 5,036,040); nickel chelates (see, e.g., U.S. Pat. Nos. 5,024,923; 4,921;317; and 4,913,846); oxoindolizines (see, e.g., U.S. Pat. No. 4,446,223); iminium salts (see, e.g., U.S. Pat. No. 5,108,873); and indophenols (see, e.g., U.S. Pat. No. 4,923,638); TiON, TiCN, tungsten oxides of chemical formula $WO_{3-X}$, where $0<x<0.5$ (with $2.7 \leqq x \leqq 2.9$ being preferred); and vanadium oxides of chemical formula $V_2O_{5-X}$, where $0<x<1.0$ (with $V_6O_{13}$ being preferred). Pigments are typically utilized in the form of aqueous or solvent dispersions.

Suitable radiation-absorptive materials provide adequate sensitivity to imaging radiation without substantially affecting formation of the inorganic-rich phase and adhesion between the multiphase layer and the substrate. For example, surface-modified carbon-black pigments sold under the trademark CAB-O-JET 200 by Cabot Corporation, Bedford, Mass. are found to minimally disrupt adhesion at loading levels providing adequate sensitivity for heating. Another preferred absorptive material is sold under the trademark BONJET BLACK CW-1, a surface-modified carbon-black aqueous dispersion available from Orient Corporation, Springfield, N.J.

Other absorbers for the multiphase layer 404 include conductive polymers, e.g., polyanilines, polypyrroles, poly-3,4-ethylenedioxypyrroles, polythiophenes, and poly-3,4-ethylenedioxythiophenes. These can be utilized alone or as copolymers or in polymer mixtures to form layer 404. For conductive polymers based on polypyrroles, the catalyst for polymerization conveniently provides the "dopant" that establishes conductivity.

Multiphase layer 404 may be applied by known mixing and coating methods. In one embodiment, a coating mix may be prepared as two separate fluids that are subsequently mixed together at a certain ratio just prior to the coating application (see Examples 1 and 2 below). In another embodiment, a coating mix may be prepared as a single fluid by mixing all the necessary components (see Examples 3, 4, 5, and 6 below).

The multiphase layer 404 is typically coated at a coating weight in the range of from about 0.5 g/m$^2$ to 5.0 g/m$^2$ and more preferably in the range of from about 1.5 g/m$^2$ to 2.0 g/m$^2$ based on the dried and cured coating. The coating mix or dispersion may be applied by any suitable method of coating application, such as, for example, wire-wound rod coating, reverse-roll coating, gravure coating, or slot-die coating. In a preferred embodiment, the coating mix is applied using wire wound rods chosen to give the above weights. Optimum wire size may vary based on the viscosity and solids of the coating mix. The selection process is routine to a person of ordinary skill in the art.

After coating, the multiphase layer is dried and cured. For example, the layer may be dried and cured in a BlueM convection oven that provides controlled temperature and sufficient air circulation. The drying rate may be important for formation of the multiphase layer 404.

3. Imaging Techniques

Imaging apparatus suitable for use in conjunction with the present printing members includes at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. Nos. Re. 35,512 and 5,385,092 (the entire disclosures of which are hereby incorporated by reference); lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image spots may be applied in an adjacent or in an overlapping fashion.

The imaging apparatus can operate on its own, functioning solely as a platemaker, or can be incorporated directly into a lithographic printing press. In the latter case, printing may commence immediately after application of the image to a blank plate, thereby reducing press set-up time considerably. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate.

In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Regardless of the manner in which the beam is scanned, in an array-type system it is generally preferable (for on-press applications) to employ a plurality of lasers and guide their outputs to a single writing array. The writing array is then indexed, after completion of each pass across or along the plate, a distance determined by the number of beams emanating from the array, and by the desired resolution (i.e., the number of image points per unit length). Off-press applications, which can be designed to accommodate very rapid scanning (e.g., through use of high-speed motors, mirrors, etc.) and thereby utilize high laser pulse rates, can frequently utilize a single laser as an imaging source.

Figure 5A:
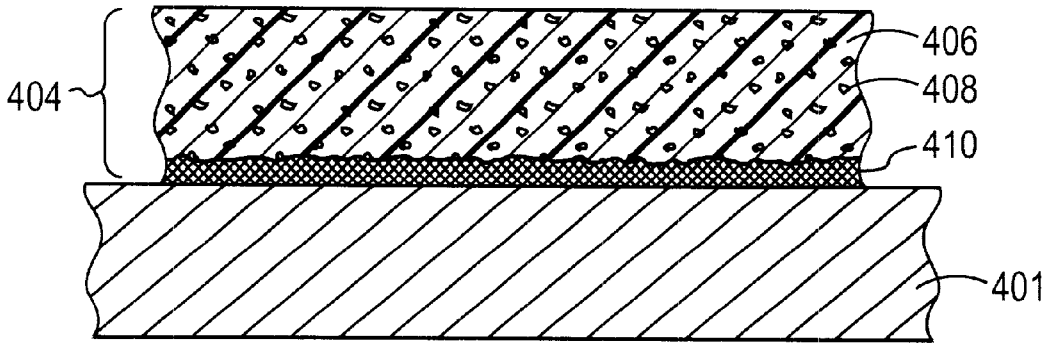
FIG. 5A is an enlarged sectional view of a lithographic printing member having a metal substrate prior to imaging.
Figure 5B:
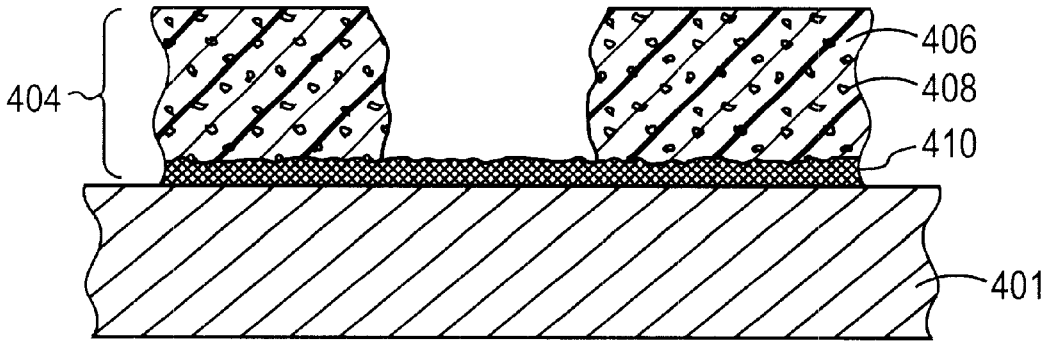
FIG. 5B is an enlarged sectional view of the lithographic printing member of FIG. 5A after exposure to imaging radiation.
Figure 7A:
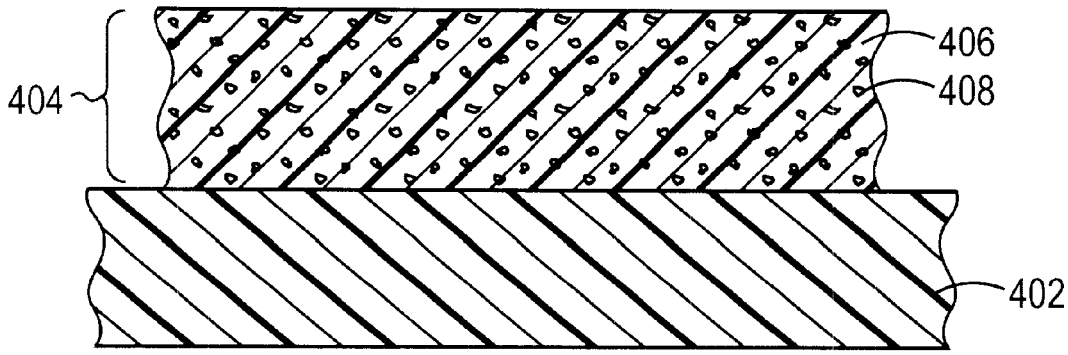
FIG. 7A is an enlarged sectional view of a lithographic printing member having a polymer substrate prior to imaging.
Figure 7B:
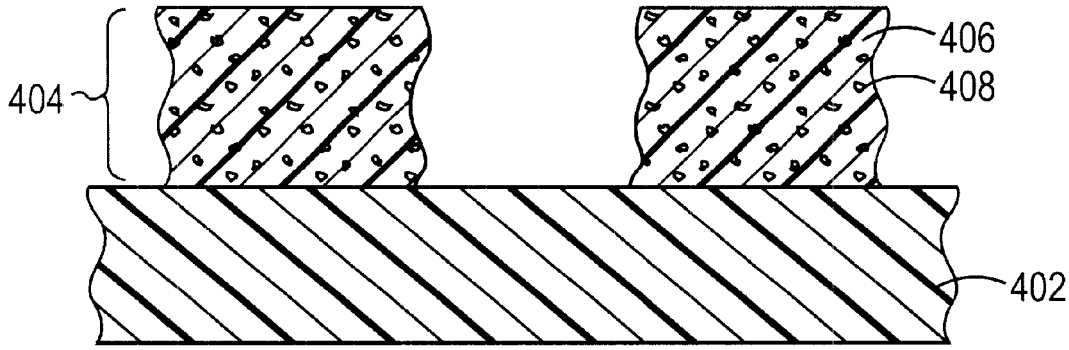
FIG. 7B is an enlarged sectional view of the lithographic printing member of FIG. 7A after exposure to imaging radiation.

Thus, a lithographic printing member of the present invention is selectively exposed, in a pattern representing an image, to the output of an imaging laser which is scanned over the member. With reference to FIGS. 5A, 5B and FIGS. 7A, 7B, the imaging mechanism may be ablative in nature, whereby at least a portion of the multiphase layer 404 is substantially destroyed by the laser pulse, thereby directly producing on the printing member an array of image features or potential image features. The imaged printing member may be cleaned with water or cleaning solutions to remove remaining debris. In one embodiment, for example, when the substrate is a hydrophilic metal substrate 401 as shown in FIGS. 5A and 5B, the portion of the multiphase layer above the inorganic-rich interfacial layer 410 is ablated, leaving the exposed surface of the interfacial layer 410 to serve as the hydrophilic surface. Alternatively, the interfacial layer 410 may also be removed during imaging or post-imaging processes, exposing the underlying hydrophilic metal layer 401. In another embodiment, for example, when the substrate is an oleophilic polymer substrate 402 as shown in FIGS. 7A and 7B, the entire multiphase layer 404 may be ablated. However, enough heat is retained within the multiphase layer 404 to avoid damaging substrate 402, which is exposed to serve as the ink-receptive surface.

Figure 6A:
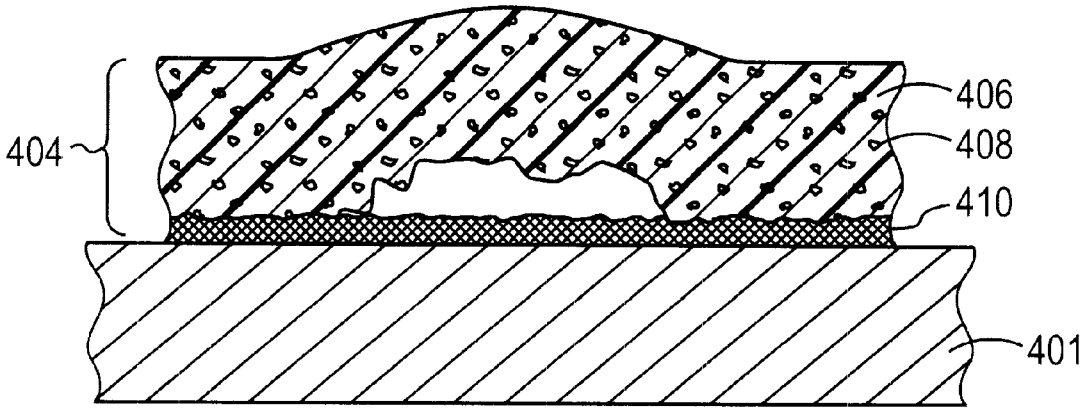
FIG. 6A illustrates imaging of the printing member of FIG. 5A so as to debond the multiphase layer from the interfacial layer.
Figure 6B:
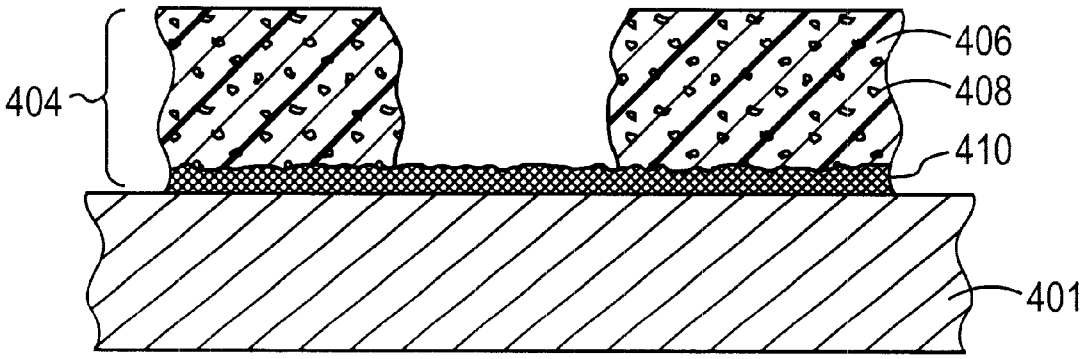
FIG. 6B is an enlarged sectional view of the printing member of FIG. 6A after a post-imaging cleaning step.
Figure 8A:
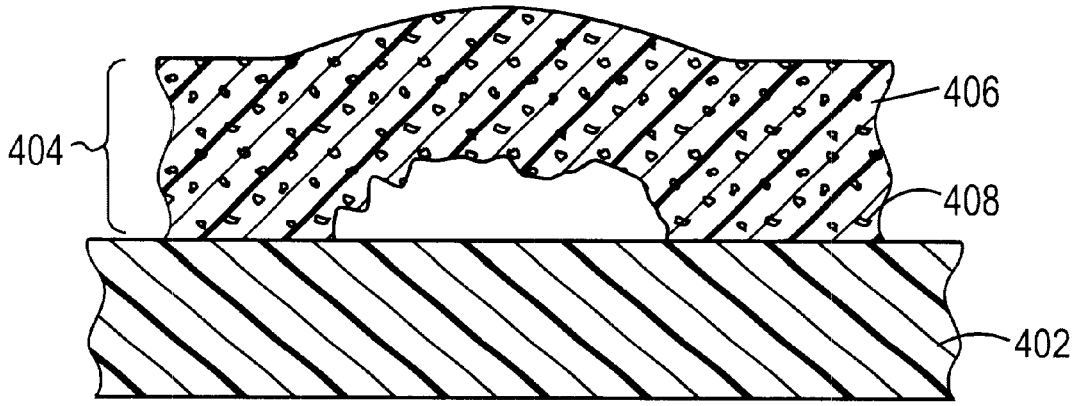
FIG. 8A illustrates imaging of the printing member of FIG. 7A so as to debond the multiphase layer from the substrate.
Figure 8B:
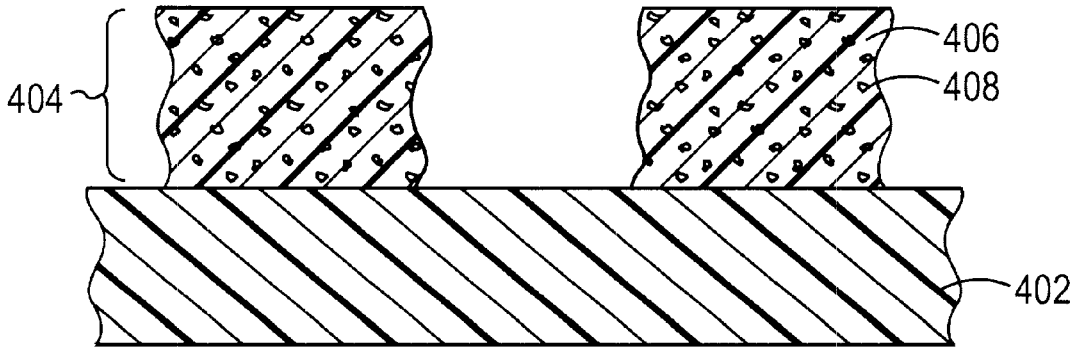
FIG. 8B is an enlarged sectional view of the printing member of FIG. 7A after a post-imaging cleaning step.

With reference to FIGS. 6A, 6B, and FIGS. 8A, 8B, the imaging mechanism may be non-ablative. In one embodiment, for example, when the substrate is a hydrophilic metal substrate 401, an imaging pulse may merely debond the portion of the multiphase layer above the interfacial layer 410 from the interfacial layer 410 without substantially ablating the multiphase layer as shown in FIG. 6A. Remnants of the portion of the multiphase layer above the interfacial layer 410 are readily removed by a post-imaging cleaning process, exposing the hydrophilic interfacial layer 410. Alternatively, the entire multiphase layer 404 including the interfacial layer 410 may be removed during post-imaging cleaning, exposing the hydrophilic metal substrate. In another embodiment, for example, when the substrate is an oleophilic polymer substrate 402, an imaging pulse may debond the entire multiphase layer 404 from the substrate 402 without substantially ablating the multphase layer as shown in FIG. 8A. Again, remnants of the multiphase layer are removed by a post-imaging process to reveal the image.

Without being bound to any particular theory or mechanism, debonding can arise from any or a combination of various effects. For example, thermal stress between dissimilar phases can induce a split therebetween; this is especially likely where the polymer-rich phase grades sharply into the inorganic-rich interfacial layer, and where the layers exhibit substantially different imaging radiation-absorption, and/or thermal-expansion, and/or heat-response (e.g., melting point) characteristics. Heating of the inorganic-rich phase can also cause partial ablation with consequent gas buildup, which lifts the polymer-rich phase and thereby de-anchors it from the substrate.

Printing members in accordance with the invention may be suitable for ablative or non-ablative imaging mechanisms. In either case, a sufficient amount of energy must be delivered to cause the desired behavior. This, in turn, is a function of parameters such as laser power, the duration of the pulse, the intrinsic absorption of the heat-sensitive multiphase layer (as determined, for example, by the concentration of absorber therein), the thickness of the multiphase layer, and the thermal conductivity of the substrate layer beneath the multiphase layer. These parameters are readily determined by the skilled practitioner without undue experimentation. It is possible, for example, to cause the same materials to undergo ablation or to simply become heated without damage through control of laser exposure time or power.

4. EXAMPLES

Exemplary formulations for solutions/dispersions that may be coated on a substrate to form a multiphase layer 404 are described in the following examples, which are offered by way of description and not by way of limitation. The components for each example are listed in the order of addition. All solutions (Sol) of the following examples are water solutions. All concentrations are based on weight. The coatings provided by the following examples are dried and cured at a temperature of 350° F. for 2 minutes with sufficient air circulation.

Example 1

A representative multiphase layer may be obtained by mixing 10 parts of the following solution B into 25 parts of solution A.

| Component (parts by weight) | Part A |
|---|---|
| Water | 33.0 |
| Bonjet CW-1 | 10.0 |
| 5% Esprix R-1130 (5 wt % in water) | 50.0 |
| Triton X-100 | 1.7 |
| Cymel 303 | 0.4 |
| Cymel 385 | 0.1 |
| NaCure 2530 | 2.8 |
| Bacote 20 | 2.0 |

-continued

| Component (parts by weight) | |
|---|---|
| | Part B |
| 5% Airvol 325 (5 wt % in water) | 87.7 |
| Triton X-100 | 0.7 |
| BYK-333 | 1.0 |
| Glycerol | 0.2 |
| Bacote 20 | 10.4 |
| Cymel 385 | 0.1 |
| NaCure 2530 | 2.8 |

ESPRIX R-1130, supplied by Esprix Chemical Co., is one of a family of polyvinyl alcohol-based copolymers that contain a low (<1 mole percent) content of a vinyl silane comonomer. These polymers are promoted for use in durable hydrophilic coatings. While this may be true in some circumstances, the coating described above is actually more hydrophobic than hydrophilic; it accepts some ink notwithstanding exposure to dampening fluid. Therefore, this example provides an oleophilic multiphase layer. The resulting printing member images with laser exposures of 300–600 mJ/cm$^2$ which are suitable for ablation based imaging mechanisms.

Example 2

A formulation is prepared by mixing 2 parts of the following fluid A into 1 part fluid B (a 2:1 blend).

| Component (parts by weight) | |
|---|---|
| | Part A |
| Water | 47.05 |
| Bonjet CW-1 | 10.0 |
| BYK 333 | 0.5 |
| BYK 348 | 0.75 |
| Airvol 325 (5 wt % in water) | 37.0 |
| Witco 240 | 2.6 |
| Cymel 373 | 1.1 |
| Nacure 2530 | 1.0 |
| | Part B |
| Airvol 325 (5 wt % in water) | 85.63 |
| Glycerol | 0.17 |
| Triton X-100 | 0.7 |
| BYK 333 | 1.0 |
| Bacote 20 (50 wt % in water) | 12.5 |

The resulting printing member images with laser exposures of 75–150 mJ/cm$^2$ which are typically below those suitable for ablative mechanisms, the imaging mechanism is therefore non-ablative.

Example 3

A formulation is prepared as a single fluid as follows.

| Component (parts by weight) | Example 3 |
|---|---|
| Water | 8.36 |
| Bonjet CW-1 | 2.85 |
| Triton X-100 (10 wt % in water) | 1.00 |

-continued

| Component (parts by weight) | Example 3 |
|---|---|
| BYK 333 (10 wt % in water) | 0.71 |
| Glycerol | 0.14 |
| Airvol 325 (5 wt % in water) | 76.94 |
| Cymel 303 | 0.11 |
| Cymel 385 | 0.03 |
| Nacure 2530 | 1.9 |
| Bacote 20 (50 wt % in water) | 7.96 |

This example provides a multiphase layer that images with laser exposures of 300–600 mJ/cm$^2$ typical of ablation imaging.

Example 4

A formulation is prepared as a single fluid as follows. Roshield 3275 is supplied by Rohm & Haas.

| Component (parts by weight) | Example 4 |
|---|---|
| Roshield 3275 | 2.5 |
| Airvol 325 (5 wt % in water) | 38.7 |
| Water | 22.65 |
| Cymel 373 (10 wt % in water) | 3.5 |
| BYK 333 (10 wt % in water) | 0.6 |
| BYK 348 (10 wt % in water) | 0.6 |
| Nacure 2530 | 0.2 |
| Bonjet CW-1 | 8.6 |
| Water | 22.65 |

This example provides a layer that images with laser exposures of 75–150 mJ/cm$^2$ typical of non-ablation imaging.

Examples 1, 2, 3 and 4 each provide an oleophilic multiphase layer that may be coated over a hydrophilic metal substrate, preferably a aluminum substrate. Exposed areas after post-imaging cleaning are receptive to an ink-rejecting fluid, such as water, aqueous and non-aqueous damping liquids, or the polar solvents of single fluid inks. Unexposed areas provide an ink-receptive surface, resulting in "positive-working" printing members.

Example 5 and Example 6

For each of Examples 5 and 6, a formulation is prepared as a single fluid. Esprix R-1130 is supplied by Esprix Chemical Co.

| Component (parts by weight) | |
|---|---|
| | Example 5 |
| Water | 59.77 |
| Bonjet CW-1 | 3.25 |
| BYK 333 (10 wt % in water) | 0.5 |
| Triton X-100 (10 wt % in water) | 0.3 |
| Esprix R-1130 (5 wt % in water) | 30.0 |
| Bacote 20 (50 wt % in water) | 6.18 |

-continued

| Component (parts by weight) | Example 6 |
|---|---|
| Water | 47.17 |
| Bonjet CW-1 | 3.25 |
| BYK 333 (10 wt % in water) | 0.5 |
| Triton X-100 (10 wt % in water) | 0.3 |
| Airvol 325 (5 wt % in water) | 42.6 |
| Bacote 20 (50 wt % in water) | 6.18 |

Examples 5 and 6 each provide a hydrophilic multiphase layer that may be coated over an oleophilic polymer substrate, such as, for example, the MELINEX 991 7 mil polyester film provided by Dupont Teijin Films, Wilmington, Del. The exposed substrate surface after post-imaging cleaning is oleophilic or ink-receptive, while unexposed areas remain receptive to an ink-rejecting fluid. Therefore, Examples 5 and 6 provide lithographic printing members that are "negative-working." The printing member of Example 5 is suitable for ablative imaging while the printing member of Example 6 is suitable for non-ablative imaging mechanisms.

It will therefore be seen that the foregoing techniques provide a basis for improved lithographic printing and superior plate constructions. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of imaging a lithographic printing member, the method comprising the steps of:

a. providing a printing member comprising a substrate layer and a multiphase layer in contact with the substrate along an interface, the multiphase layer having a polymer-rich phase and an inorganic-rich phase, wherein the polymer-rich phase has a different affinity at least from the substrate layer for a printing liquid, and the inorganic-rich phase does not substantially absorb imaging radiation;

b. exposing in an imagewise pattern the printing member to imaging radiation so as to remove or facilitate removal of at least a portion of the multiphase layer; and c. removing remnants of the multiphase layer, thereby creating an imagewise lithographic pattern on the printing member.

2. The method of claim 1 wherein the substrate is a hydrophilic metal substrate.

3. The method of claim 1 wherein the substrate is an oleophilic polymer substrate.

4. The method of claim 3 wherein the inorganic-rich phase comprises nodules dispersed within the polymer-rich phase.

5. The method of claim 4 wherein the polymer substrate is polyester.

6. The method of claim 4 wherein the inorganic-rich phase comprises zirconium oxide.

7. The method of claim 3 wherein the multiphase layer debonds without substantial ablation from the substrate in response to exposure to imaging radiation.

8. The method of claim 1 wherein the polymer-rich phase comprises crosslinked polyvinyl alcohol.

9. The method of claim 1 wherein the inorganic-rich phase comprises zirconium oxide.

10. The method of claim 1 wherein the multiphase layer comprises a material that absorbs imaging radiation.

11. The method of claim 10 wherein the multiphase layer is subject to ablative absorption of imaging radiation.

12. The method of claim 1 wherein the printing liquid is ink.

13. The method of claim 1 wherein the printing liquid is an ink-rejecting fluid.

14. A method of imaging a lithographic printing member, the method comprising the steps of:

a. providing a printing member comprising a hydrophilic metal substrate layer and a multiphase layer in contact with the substrate along an interface, the multiphase layer having a polymer-rich phase and an inorganic-rich phase, wherein (i) the polymer-rich phase has a different affinity at least from the substrate layer for a printing liquid and, (ii) the inorganic-rich phase comprises nodules dispersed within the polymer-rich phase and an interfacial layer within the multiphase layer;

b exposing in an imagewise pattern the printing member to imaging radiation so as to remove or facilitate removal of at least a portion of the multiphase layer; and c. removing remnants of the multiphase layer, thereby creating an imagewise lithographic pattern on the printing member.

15. The method of claim 14 wherein the metal substrate is aluminum.

16. The method of claim 14 wherein the interfacial layer has a thickness no greater than 5 nm.

17. The method of claim 14 wherein the interfacial layer remains over the substrate notwithstanding the exposing and removing steps, thereby serving as the hydrophilic surface.

18. The method of claim 14 wherein the removing step removes the interfacial layer to reveal the metal substrate.

19. The method of claim 14 wherein the inorganic-rich phase comprises zirconium oxide.

20. The method of claim 14 wherein at least a portion of the multiphase layer debonds without substantial ablation from the interfacial layer in response to exposure to imaging radiation.

21. A lithographic printing member comprising a substrate layer and a multiphase layer in contact with the substrate along an interface, the multiphase layer having a polymer-rich phase and an inorganic-rich phase, wherein:

(i) the polymer-rich phase has a different affinity at least from the substrate for a printing liquid;

(ii) the inorganic-rich phase is characterized by not substantially absorbing imaging radiation; and (iii) the multiphase layer is characterized by absorption of imaging radiation, thereby facilitating removal of at least a portion of the multiphase layer.

22. The member of claim 21 wherein the substrate is a hydrophilic metal substrate.

23. The member of claim 21 wherein the substrate is an oleophilic polymer substrate.

24. The member of claim 23 wherein the inorganic-rich phase comprises nodules dispersed within the polymer-rich phase.

25. The member of claim 24 wherein the polymer substrate is polyester.

26. The member of claim 24 wherein the inorganic-rich phase comprises zirconium oxide.

27. The member of claim 21 wherein the polymer-rich phase comprises crosslinked polyvinyl alcohol.

28. The member of claim 21 wherein the inorganic-rich phase comprises zirconium oxide.

29. The member of claim 21 wherein the multiphase layer comprises a material that absorbs imaging radiation.

30. The member of claim 29 wherein the multiphase layer is subject to ablative absorption of imaging radiation.

31. The member of claim 21 wherein the polymer-rich phase has a different affinity at least from the substrate for ink.

32. The member of claim 21 wherein the polymer-rich phase has a different affinity at least from the substrate for an ink-rejecting fluid.

33. A lithographic printing member comprising a hydrophilic metal substrate layer and a multiphase layer in contact with the substrate along an interface, the multiphase layer having a polymer-rich phase and an inorganic-rich phase, wherein:

(i) the polymer-rich phase has a different affinity at least from the substrate for a printing liquid;

(ii) the inorganic-rich phase comprises nodules dispersed within the polymer-rich phase and an interfacial layer within the multiphase layer; and (iii) the multiphase layer is characterized by absorption of imaging radiation, thereby facilitating removal of at least a portion of the multiphase layer.

34. The member of claim 33 wherein the metal substrate is aluminum.

35. The member of claim 33 wherein the interfacial layer has a thickness no greater than 5 nm.

36. The member of claim 33 wherein the interfacial layer resists removal to thereby serve as the hydrophilic surface.

37. The member of claim 33 wherein the interfacial layer is subject to post-imaging removal.

38. The member of claim 33 wherein the inorganic-rich phase comprises zirconium oxide.

* * * * *